United States Patent [19]

Millay et al.

[11] Patent Number: 4,612,735

[45] Date of Patent: Sep. 23, 1986

[54] DRILL BIT LUG FIXTURE

[75] Inventors: Lawrence I. Millay; Victor F. Dzewaltowski, both of Springfield, Vt.

[73] Assignee: Ex-Cell-O Corporation, Troy, Mich.

[21] Appl. No.: 659,146

[22] Filed: Oct. 9, 1984

[51] Int. Cl.[4] ..... B24B 41/06

[52] U.S. Cl. ..... 51/217 R; 51/217 A; 269/60; 269/157; 269/902; 269/258

[58] Field of Search ..... 51/217 R, 217 A; 269/902, 239, 258, 32, 157, 60

[56] References Cited

U.S. PATENT DOCUMENTS

| | | | |
|---|---|---|---|
| 235,469 | 12/1880 | Stephens | 269/258 |
| 1,060,477 | 4/1913 | Meyers | 269/157 |
| 2,107,566 | 2/1938 | Gardner | 51/217 A |
| 2,364,150 | 12/1944 | Lowenstein | 269/902 |
| 2,416,782 | 3/1947 | Valish | 269/60 |
| 2,612,821 | 10/1952 | Skay | 51/217 R |
| 3,211,446 | 10/1965 | Headrick | 269/902 |

*Primary Examiner*—Frederick R. Schmidt
*Assistant Examiner*—Joseph T. Zatarga
*Attorney, Agent, or Firm*—Edward J. Timmer

[57] ABSTRACT

A workpart fixture for an unbalanced drill bit lug includes a support having a vee-shaped recess with an included angle substantially the same as vee-shaped intersecting surfaces on the drill bit lug to receive same and a fluid actuated clamp assembly carried on an arcuate slide which is movable in a circular arc path laterally relative to the drill bit lug generally about a centerline through the drill bit lug body to accommodate right or left linear or angular offset of the line of intersection of the vee-shaped lug surfaces and to optimize clamping force on the lug in the fixture. The clamp assembly includes a clamp lever which is pivotal toward and away from the drill bit lug by a fluid actuator and which carries swiveling clamp pads that seat against the drill bit lug when the clamp lever is actuated by the cylinder.

12 Claims, 8 Drawing Figures

DRILL BIT LUG FIXTURE

FIELD OF THE INVENTION

The invention relates to a workpart fixture for a machine tool such as a grinding machine.

BACKGROUND OF THE INVENTION

Oilwell rotary cone drill bit lugs include a journal which projects from a relatively massive cast body and which must be ground to close tolerance for mounting a cutter bit rotatably thereon by bearings for example as shown in U.S. Pat. No. 4,446,933 to Bodine. The journal projects from the rather bulky body which has a pair of machined flat surfaces intersecting one another on a front side thereof facing in the same direction as the projecting journal to form a vee profile having an included angle of 120° for example. The drill bit lugs thus are unbalanced in configuration and weight. Typically, such drill bit lugs are made in various sizes and with the line of intersection of the machined flat vee surfaces skewed or offset either right or left relative to the vertical centerline through the projecting journal.

What is needed is a fixture to securely clamp such unbalanced workparts in a grinding machine or other machine tool with the journal in precise position for machining.

SUMMARY OF THE INVENTION

The invention provides a workpart fixture which is adapted to securely clamp such workparts as the unbalanced drill bit lugs described and like workparts in position on a machine tool and capable of accommodating different workpart sizes and right or left skew angle and/or linear offsets of the machined vee surfaces on the lug body.

In a typical working embodiment, the invention provides such a workpart fixture which includes a vee recess formed by intersecting support surfaces having generally the same included angle therebetween as the machined vee surfaces of the workpart and a clamp assembly angular positional relative to the centerline of the machine tool spindle and workpart to clamp the vee workpart surfaces in the recess against the fixture support surfaces preferably with the clamping force exerted substantially normal to a back side of the workpart body so as to optimize clamping forces. The clamp assembly is angularly slidable in a circular arc in the lateral right or left hand direction relative to the workpart by being carried on an arcuate slide means whose radial center or pivot axis preferably coincides generally with the centerline of the workpart such as the drill bit lug. Preferably, the arcuate slide is slidable arcuately in a plane substantially normal to the centerline through the drill bit lug. In this way, a drill bit lug with a right or left offset of the line of intersection of its intersecting vee surfaces can be accommodated and clamping force optimized, especially on the back or rear lug surface engaged by the clamp assembly. The clamp assembly preferably includes a cylinder means which actuates a clamp lever to swing toward the workpart and carry clamp pads to engage the back or rear side of the workpart. The clamp lever typically carries a clamp head comprising a clamp plate and a pair of clamp pads, both the clamp plate and pads being capable of swivel or pivoting to optimize clamping engagement with the rear side of the workpart.

Typically, the vee-shaped recess of the fixture is formed by a replaceable vee member having support surfaces machined, cast or other formed therein to together define the appropriate recess for a particular drill bit lug. The replaceable member is releasably received on a locating block, plate or other member attached to the machine workhead or base. Locating pads with a locating pin may be releasably fastened on the support surfaces forming the recess to provide workpart location.

DESCRIPTION OF PREFERRED EMBODIMENTS

Figure 4:
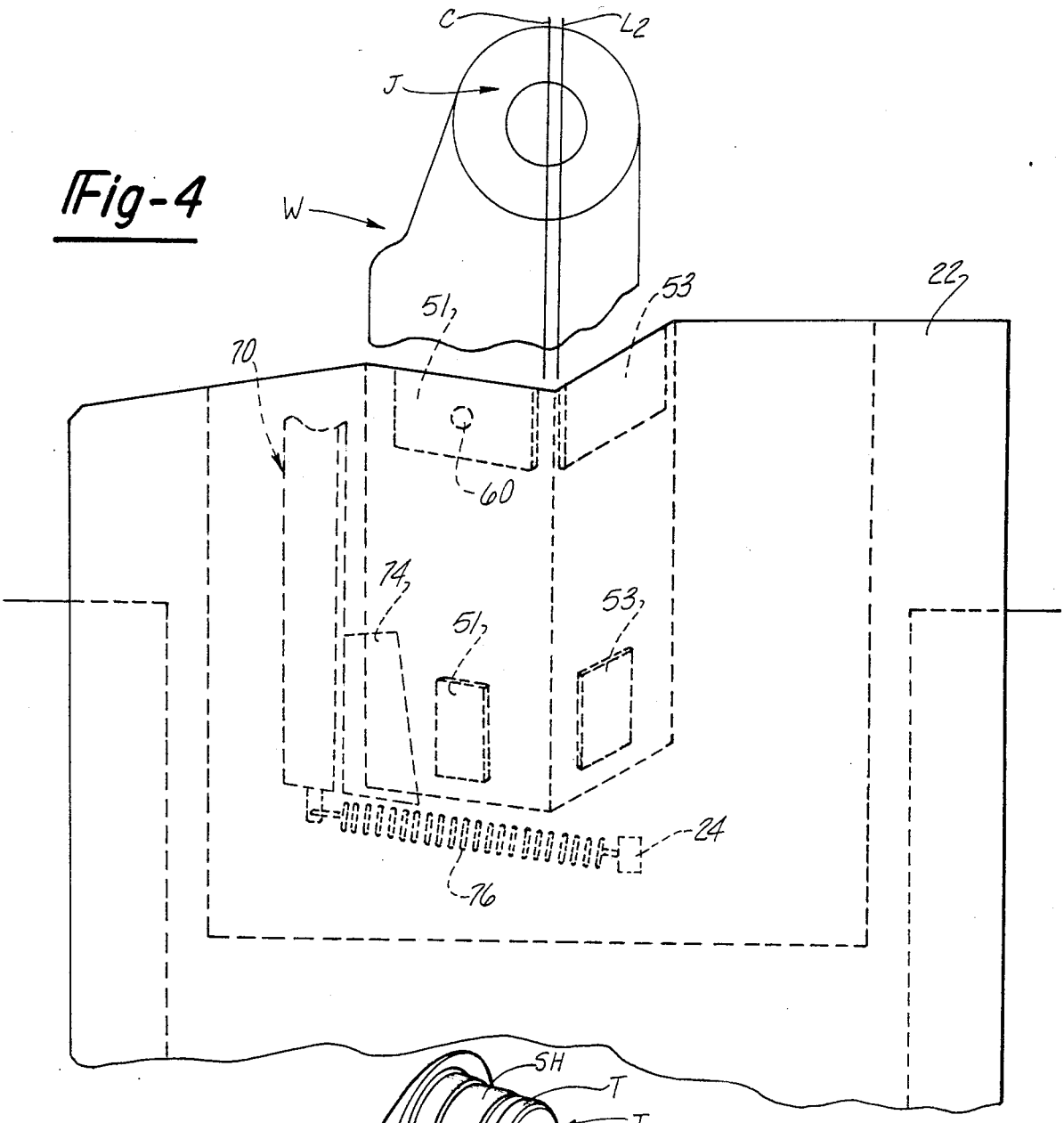
FIG. 4 is a front elevation of the support plate of the workpart fixture showing the recess adapted to receive the vee profile of the workpart.

Referring to FIGS. 2 through 8, a workpart fixture 10 constructed in accordance with the invention is illustrated as fixedly mounted on the rotatable workhead 12 of a grinding machine for rotation therewith although the fixture could be mounted in stationary fashion on the machine. The fixture includes a fixed workpart support 20 comprised of a first support block 22 and second support plate 24 bolted or otherwise secured together across the workhead transverse to the rotational axis of the spindle (not shown) carried on the grinding machine. The workpart support 20 includes an elongated channel 26 inclined upwardly relative to vertical as shown; i.e., inclined upwardly from the workhead in the direction of the spindle. The bottom of channel 26 includes similarly inclined grooves 28 adapted to receive elongated keys 30. Workpart support 20 is mounted fixedly on a tubular frame 172 having a cylindrical outer periphery.

Positioned and located by keys 30 in channel 26 is a vee member 40 having a pair of lateral flanges 42 bolted or otherwise releasably secured to the support 20 by machine screws 44 or the like. The vee member 40 has shoulders 46,48 which intersect along a line $L_1$ and together form a vee-shaped recess 50 as shown. Each shoulder includes a groove **46*a*,48*a* along the length thereof to receive wear resistant locating pads 51 and 53 releasably attached to the shoulders 46,48 by machine screws 54. It is apparent that the uppermost pad 51*a* includes a projecting locating pin 60** substantially normal to the plane of the pad for purposes to be explained.

At the lowermost end of the vee member 40 is an end stop or locating member 62 affixed thereto for purposes to be explained.

Figure 1:
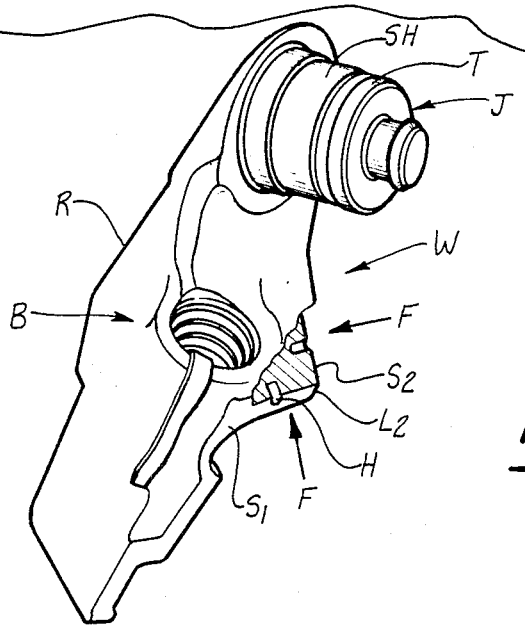
FIG. 1 is a perspective view of a drill bit lug.
Figure 2:
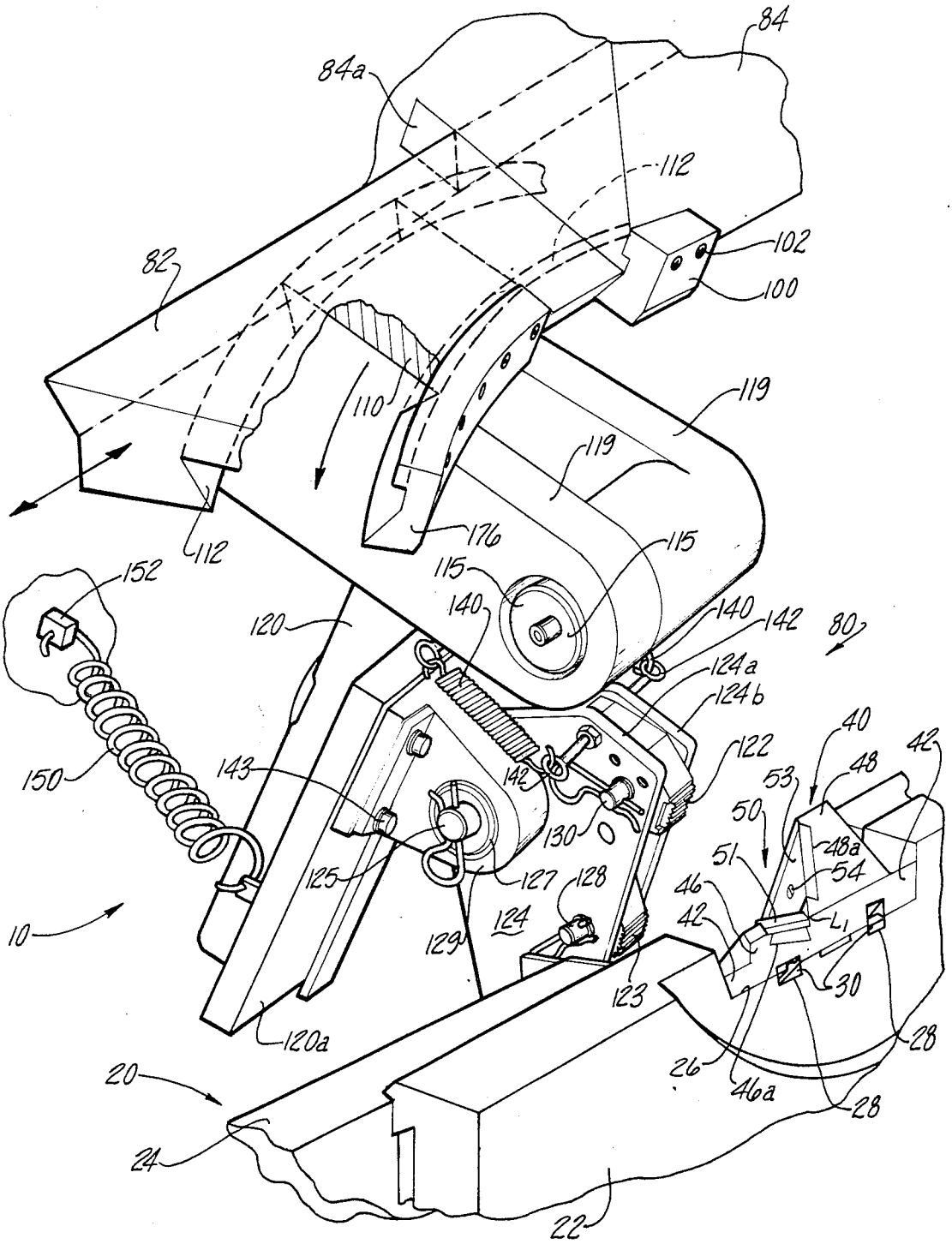
FIG. 2 is a perspective view, partially broken away, of the workpart fixture.

The vee-shaped member 40 is adapted to receive the drill bit lug W of FIG. 1 having a bulky body B and journal J projecting therefrom as shown. In the front side F of the body are a pair of flat machined surfaces $S_1,S_2$ intersecting to form a 120° included angle. As will be explained below, the line of intersection $L_2$ of surfaces $S_1,S_2$ is offset to the right of a vertical centerline through the journal. The front surface $S_1$ includes a hole H. The journal includes a ball track T, and shaft SH to be ground. The rear side R of the lug body is generally cylindrical in cast profile and includes casting tolerances and irregularities.

Figure 3:
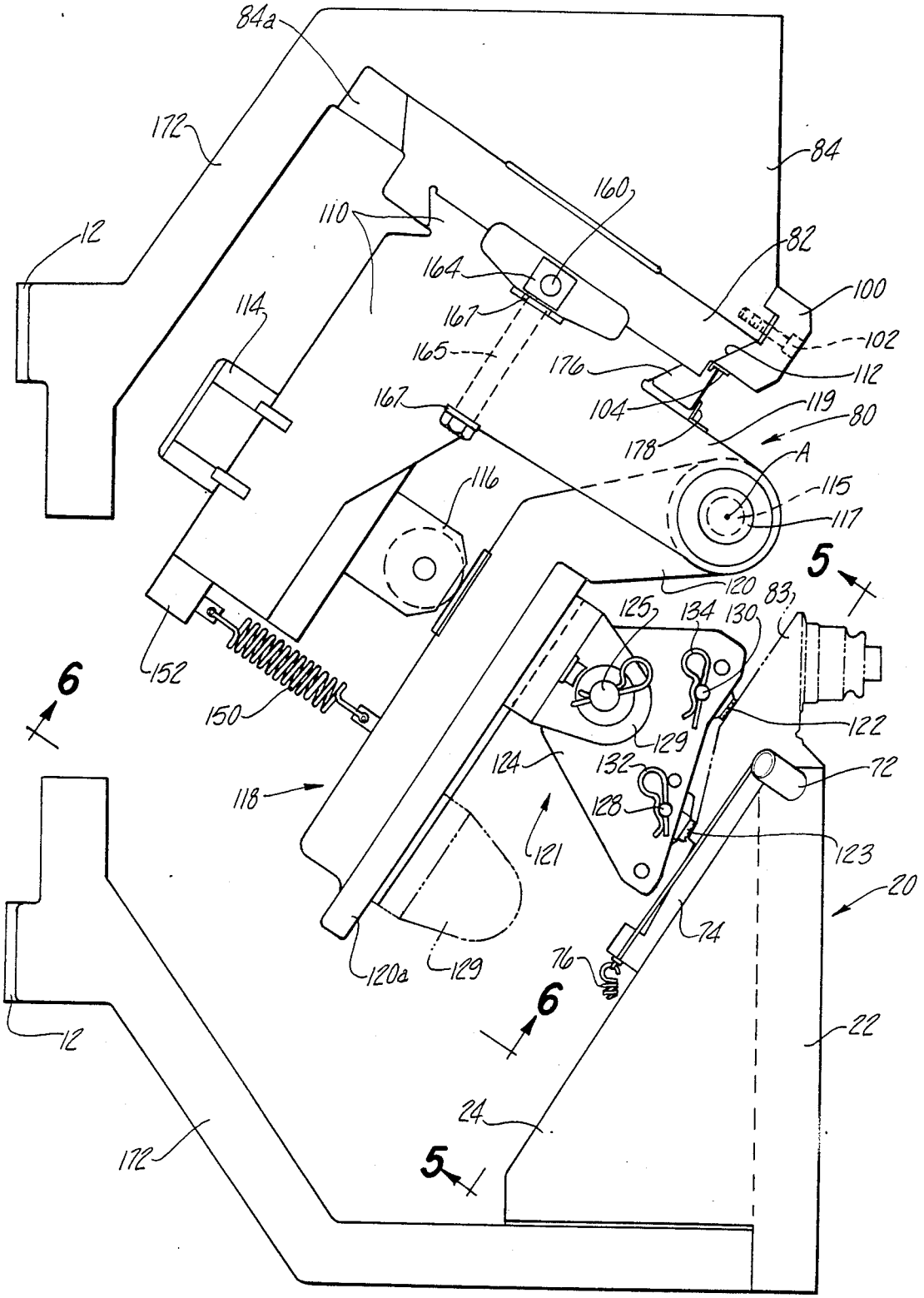
FIG. 3 is a side elevation of the workpart fixture with the tubular fixture frame in cross-section.
Figure 6:
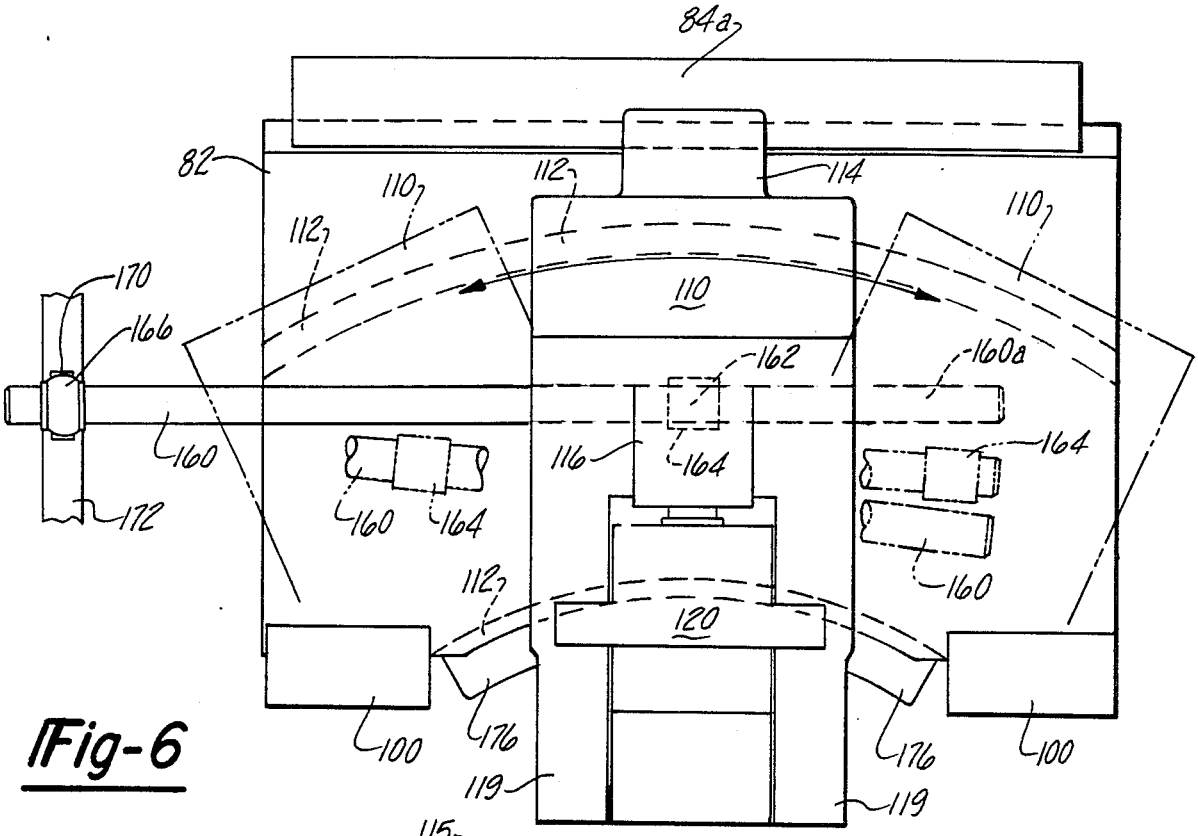
FIG. 6 is an elevation looking up in direction of arrows 6—6 of FIG. 3 of the workpart fixture showing the compound slide assembly.
Figure 5:
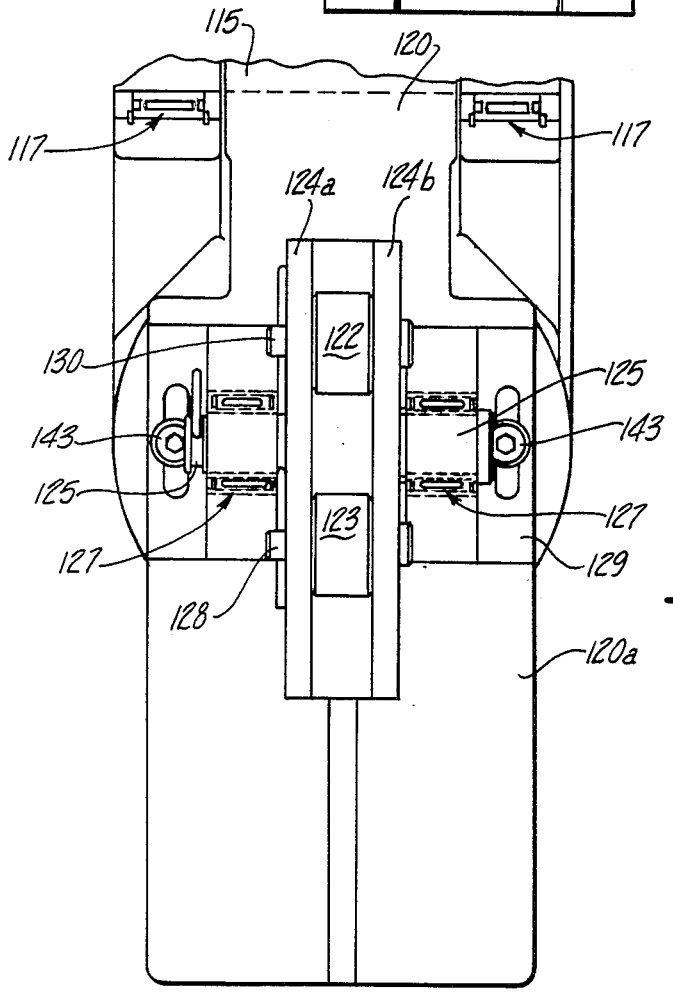
FIG. 5 is a front elevation in the direction of arrows 5—5 in FIG. 3 of the clamp head.

The drill bit lug W is shown in FIG. 3 received in the vee member 40 with machined intersecting surfaces $S_1,S_2$ positioned and supported against the locating pads on shoulders 46,48 with the journal J substantially horizontally oriented above the support 20 coaxial with the rotational axis of the workpart fixture and with the lower end of the lug body B abutted against end stop 62 on the vee member 40. The locating pin 60 is received in hole H of the lug body and together with pads 51,53 position the drill bit lug W in the vee member 40.

Figure 7:
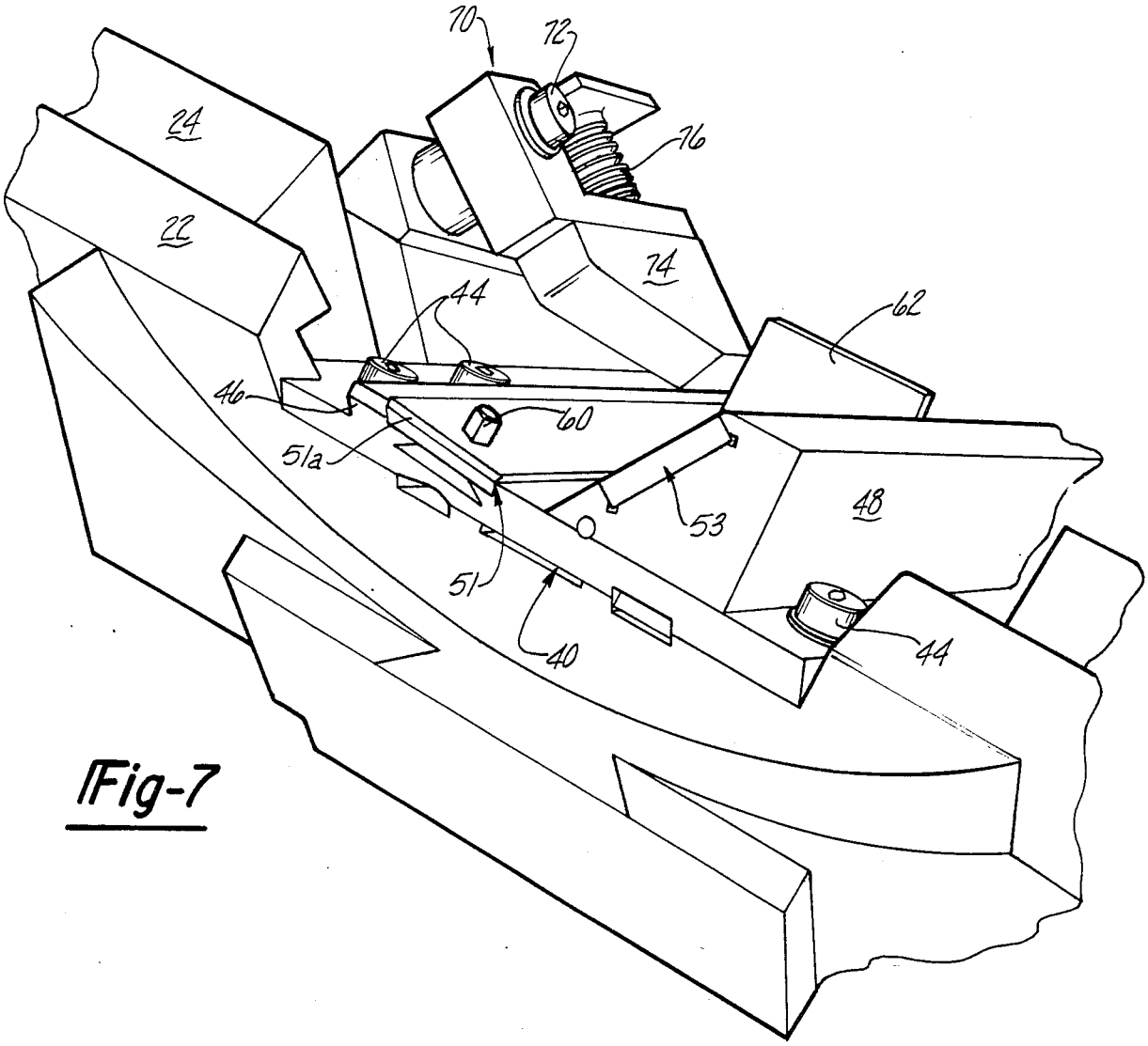
FIG. 7 is a perspective view of the clamp mechanism in the recess of the vee member.
Figure 8:
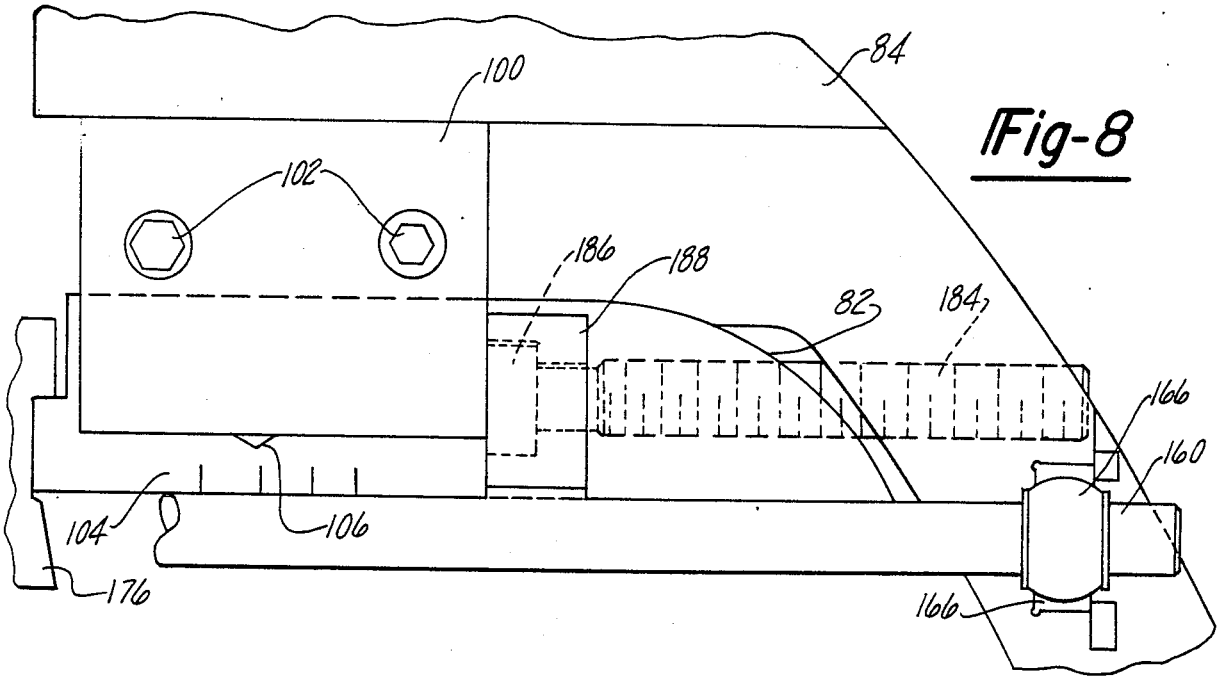
FIG. 8 is a partial front elevation of the compound slide showing the linear slide adjustment screw.

A side clamp 70 is mounted on support plate 24 and is spring-biased to bias the drill bit lug W toward the right in FIG. 7 to insure proper seating of the lug body in the vee member 40 prior to hydraulic clamping of the lug body therein as explained below. The side clamp comprises a cylindrical shaft 72, a clamp member 74 pivotally mounted on shaft 72 and spring 76 biasing the clamp member 74 into the recess 50 so as to engage the adjacent side of the lug body B and bias same into the recess 50 against the locating pads on shoulders 46,48. When the drill bit lug is placed in the vee member 40, side clamp 70 automatically biases the lug body by action of spring 76 into proper position.

Hydraulic clamping of the drill bit lug after initial positioning in vee member 40 is effected by hydraulic clamp mechanism 80. Clamp mechanism 80 comprises a linearly movable slide 82 slidably mounted on fixture frame plate 84 by a dovetail joint arrangement, as shown. Slide 82 is movable laterally in a inclined plane right and left relative to the drill bit lug in FIG. 2 by push/pull adjustment screw 184. Screw 184 has one enlarged end 186 received in enclosure 188 mounted on the linear slide 82 and another end threadably engaged in the fixture frame plate 84. When adjustment screw is rotated, the linear slide 82 is caused to move either right or left depending on the direction of screw rotation. Once in adjusted position, the linear slide 82 is clamped in releasable fixed position by a pair of clamps 100 by tightening machine screws 102 therethrough. Slide 82 may carry an indicia plate 104 to cooperate with a pointer 106 carried on clamp 100 so that the slide 82 can be accurately adjusted to a selected linear position for reasons to be explained.

The linear slide 82 carries on the underside thereof an arcuate slide 110 by a circular arc dovetail joint arrangement. The radius of the circular arc dovetail joint or groove 112 in the underside of linear slide 82 has its center on the centerline of the lug body B. The arcuate slide 110 carries a hydraulic cylinder 114 having piston 116 and a clamp assembly 118. The clamp assembly 118 includes a pivotal clamp lever arm 120 mounted by pivot pin 115 and bearings 117 on clamp support 119 on arcuate slide 110 for pivoting in a vertical plane about horizontal pivot axis A. The clamp lever arm 120 carries a clamp head 121 comprising clamp pads 122,123 pivotal between bifurcated plate 124 itself pivotally mounted on the clamp arm by pivot pin 125, bearings 127 and yoke 129 attached to clamp arm 120. Pads 122,123 are pivotally mounted between plate segments **124*a,b* by cross pins 128,130 and associated clips 132,134. A pair of parallel return springs 140 has one end connected to clamp lever arm 120 and the other end to screw eyelet 142 to bias bifurcated plate 124 counterclockwise in an operative position for advancement toward the drill bit lug W. Yoke 129 is attached to clamp 120 by machine screws 143 and can be adjusted along the length of arm plate 120*a*** as shown in phantom in FIG. 3.

A pair of return springs 150 have one end connected to clamp lever arm 120 and the other end to the plate 152 which is fastened to slide 110 to bias the clamp lever arm 120 clockwise about pivot pin 115.

Arcuate adjustment of slide 110 is effected by adjustment screw 160 having threaded end **160*a* threadably received in threaded bore 162 in bushing 164 which is rotatably mounted on arcuate slide 110 by shaft 165 rotatable on thrust bearings 167. The adjustment screw 160 has another end with a ball pivot 166 seated in a ball race 170 affixed on fixture frame plate 172. By turning screw 160, the arcuate slide 110 can be moved along the circular arc clockwise or counterclockwise depending upon the direction of screw rotation. During arcuate slide movement, the bushing 164 and ball pivot 166 are free to rotate. The arcuate position of slide 110 is locked releasably in selected position by screw clamps 176**.

The clamp head 119 carries a pointer 178 movable relative to indicia or scale plate (not shown) fixed on clamp 176 to indicate the arcuate position.

Once the drill bit lug W is in position in the recess of vee member 40, the linear slide 82 is adjusted by push/pull screw 84 to move clamp lever assembly 118 transverse to the axis of journal J to accommodate offset and skew angle and tolerance variations among drill bit lugs of different size and is then releasably locked in position. Then, arcuate slide 110 is slid in a circular arc path by rotation of adjustment screw 160 to position the clamp pads 122,123 in optimum position to clamp against the rear side of the lug body B and to accommodate the right or left skew offset of the vee surfaces $S_1,S_2$ of the particular drill bit lug being clamped. Typically, the clamp pads will be oriented by arcuate slide 110 to exert a clamp force normal to the rear side of the drill bit lug. Arcuate slide 110 is locked releasably in adjusted position by clamps 176. The hydraulic cylinder 114 is then actuated to cause piston 116 to engage and pivot clamp lever arm 120 about pivot axis A counterclockwise to cause clamp pads 122,123 to engage the rear side of the lug body as shown in FIG. 3. Bifurcated plate 124 can pivot about pin 125 during engagement with the rear side of the drill bit lug and clamp pads 122,123 can pivot or swivel about cross-pins 128,130 to insure proper seating thereof against the rear side of the lug body B. In this way, the drill bit lug W is held and clamped securely in recess 50 of vee member 40 with the journal J horizontal and coaxially aligned with the spindle of the grinding machine. Grinding of the journal surfaces can then take place.

The drill bit lug W shown in the Figure has the line of intersection $L_2$ of vee surfaces $S_1,S_2$ offset to the right of a vertical centerline C through the journal (FIG. 4) and arcuate slide 110 has been slid counterclockwise in a circular arc path as shown to accommodate the right hand offset and optimize clamping face substantially normal to the rear side of the lug body. Of course, for a drill bit lug having the line of intersection of vee surfaces $S_1,S_2$ offset to the left, the arcuate slide 110 would be slid clockwise and the vee member 40 would have a recess 50 reversed to receive the left hand offset of the vee surfaces $S_1$,$S_2$.

While certain specific and preferred embodiments of the invention have been described in detail hereinabove, those skilled in the art will recognize that various modifications and changes can be made therein within the scope of the appended claims which are intended to include equivalents of such embodiments.

We claim:

1. A workpart fixture for mounting a workpart on a machine tool wherein the workpart has a body with intersecting body surfaces on a side thereof forming a shaped profile with a selected included angle and wherein the workpart has a projection to be machined extending from the body with said intersecting body surfaces defining a line of intersection offset laterally relative to the projection, comprising a stationary workpart support means having a shaped recess complementary in shape to said shaped profile with intersecting recess surfaces defining an included angle generally the same as said selected included angle to receive said shaped profile of the workpart and with a line of intersection of said recess surfaces offset laterally to correspond to the offset of the line of intersection of said intersecting body surfaces, a slide means moveable laterally relative to workpart in a circular arc path opposite to the direction of lateral offset of the line of intersection of the recess surfaces, clamp means carried on the slide means for movement therewith, means for pivotably mounting the clamp means on the slide means for pivotable movement toward the workpart transverse to the to the slide means for engaging the workpart on another side thereof to exert a clamp force to cause said shaped profile to be clamped in said recess and means carried on the slide means for pivoting said clamp means toward the workpart transverse to the slide means for engaging said clamp means with said another side of the workpart.

2. The fixture of claim 1 wherein the clamp means is carried on an arcuate slide slidable along a circular arc path.

3. The fixture of claim 2 wherein the arcuate slide is slidable in the circular arc path laterally relative to the workpart with the path having a radial center coinciding generally with a centerline through the workpart.

4. The fixture of claim 2 wherein the clamp means includes a fluid actuator carried on said arcuate slide and a clamp lever pivotally mounted on said arcuate slide for pivoting toward and away from the workpart and actuated by said actuator to engage said another side of the workpart for clamping same in said recess.

5. The fixture of claim 4 wherein the clamp lever carries swiveling clamp pads to seat against the workpart.

6. The fixture of claim 2 wherein the arcuate slide includes a rotatably mounted bushing having a threaded bore and wherein a threaded screw has an end threadably received in said bore and another end pivotally mounted on the machine tool whereby said arcuate slide is slidable in a circular arc by turning said screw.

7. The fixture of claim 6 wherein said another end of said screw includes a ball pivot which is pivotable on race means affixed on the machine tool.

8. The fixture of claim 1 wherein the intersecting workpart surfaces form a vee-shaped profile on said side and said recess has a complementary vee shape to receive said profile.

9. The fixture of claim 8 wherein the vee-shaped recess is formed by locating plates attached on a replaceable support member.

10. The fixture of claim 9 wherein the locating plates are releasably attached to the replaceable support member.

11. The fixture of claim 8 wherein the vee-shaped recess is upstanding at an angle relative to horizontal such that a journal on the workpart is oriented substantially horizontally and coaxially with a spindle on the machine tool.

12. The fixture of claim 2 wherein said arcuate slide is carried on a linearly movable slide.

* * * * *